US006681766B1

(12) United States Patent
Matsuoka

(10) Patent No.: US 6,681,766 B1
(45) Date of Patent: Jan. 27, 2004

(54) REGULATOR FOR DIVING

(75) Inventor: Mitsushiro Matsuoka, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/149,286

(22) PCT Filed: Oct. 13, 2000

(86) PCT No.: PCT/JP00/07143

§ 371 (c)(1),
(2), (4) Date: Jun. 11, 2002

(87) PCT Pub. No.: WO02/32760

PCT Pub. Date: Apr. 25, 2002

(51) Int. Cl.[7] ..... B63C 11/02

(52) U.S. Cl. ..... 128/201.27; 128/200.25; 128/200.29

(58) Field of Search ..... 128/200.25, 200.29, 128/201.26, 201.27, 201.28, 206.29, 201.11; 405/186, 187; 181/127, 21

(56) References Cited

U.S. PATENT DOCUMENTS 4,168,721 A * 9/1979 Mueller, Jr. ..... 137/514.7
4,494,537 A * 1/1985 Gottlieb ..... 128/204.26
5,092,325 A * 3/1992 Ainscough ..... 128/201.27
5,233,976 A * 8/1993 Ferguson ..... 128/204.26
5,251,618 A * 10/1993 Christianson ..... 128/205.24
5,259,375 A * 11/1993 Schuler ..... 128/204.24
5,368,018 A * 11/1994 Stone ..... 128/201.28
5,474,099 A * 12/1995 Boehmer et al. ..... 137/15.18
5,503,140 A * 4/1996 Winefordner et al. . 128/200.29
5,509,407 A 4/1996 Schuler
5,549,107 A * 8/1996 Garraffe et al. ..... 128/204.26
5,660,502 A * 8/1997 Ferguson ..... 405/186
5,678,541 A * 10/1997 Garraffa ..... 128/205.24
5,690,100 A * 11/1997 Pomerantz ..... 128/205.24
5,724,961 A * 3/1998 Tistrand ..... 128/205.24
5,803,073 A * 9/1998 Toth ..... 128/205.24
5,911,220 A 6/1999 Morgan
5,944,054 A * 8/1999 Saieva ..... 137/625.4
5,960,793 A * 10/1999 Matsuoka et al. ..... 128/204.26
6,021,778 A * 2/2000 Garofalo ..... 128/204.26
6,089,225 A * 7/2000 Brown et al. ..... 128/200.29
6,263,871 B1 * 7/2001 Brown et al. ..... 128/200.29
6,332,464 B1 * 12/2001 Chen ..... 128/204.26
6,354,291 B1 * 3/2002 Brown et al. ..... 128/200.29
6,435,032 B1 * 8/2002 Holloway et al. ..... 73/713

* cited by examiner

*Primary Examiner*—Weilun Lo
*Assistant Examiner*—Mike Mendoza
(74) *Attorney, Agent, or Firm*—Clark & Brody

(57) ABSTRACT

An air guide tube 62 is mounted within a tubular portion 42 formed in a housing 13 of a regulator 1 for diving. One end of the tube 62 is formed with a valve seal 63A against which a valve 72 is pressed and another end opposite to this end is formed on its inner surface with threads 67.

3 Claims, 9 Drawing Sheets

REGULATOR FOR DIVING

TECHNICAL FIELD

The present invention relates to a regulator for diving and more particularly to such a regulator suitable to be used as a regulator usually referred to as a second stage.

BACKGROUND ART

A regulator for diving is well known, which comprises a basic structure adapted to be kept in air-tight condition so long as a diver is using it, a built-in pressure-controllable air supply mechanism provided in the basic structure, a mouthpiece connected to the basic structure and a check valve mounted on the basic structure so as to be switched between its opened and closed positions. The air supply mechanism comprises a housing connected to an air supply source provided externally of the basic structure, a pressure regulating valve and a valve seal against and from which the pressure regulating valve is pressed or disengaged, wherein the valve seal is formed on an end of a sleeve telescopically mounted in a tubular portion of the housing.

With such a regulator of prior art, there is an O-ring between the sleeve and the tubular portion of the housing in order that possible leak of the air within the basic structure may be effectively prevented. Such leak-proof measure necessarily requires that the sleeve should be held in close contact with the inner surface of the tubular portion, so it is often difficult to insert or withdraw the sleeve into or from the tubular portion. Operation of inserting or withdrawing the sleeve may sometimes damage the valve seal and the sleeve may be exchanged with a fresh one. Furthermore, the end of the sleeve may be sometimes worked to have a sharp edge in order to improve a more close contact between the valve and the valve seal. If such sharp-edged end is left in close contact with the valve made of flexible elastic material for a long period of time, tightness at which these two elements are kept in close contact with each other may unacceptably increase. As a result, it is apprehended that the valve might be prevented from smoothly operating.

It is an object of the present invention to improve an above-cited regulator of prior art so that the sleeve having the valve seal may be easily inserted or withdrawn into or from the housing and the valve may be smoothly disengaged from the valve seal.

DISCLOSURE OF THE INVENTION

According to the present invention, there is provided a regulator for diving comprising a basic structure adapted to be kept in substantially air-tight condition so long as a diver is actually using it, a pressure-controllable air supply mechanism provided in the basic structure to supply the diver with air, a mouthpiece connected to the basic structure and a check valve provided in the basic structure so as to be switched between opened and closed positions.

The air supply mechanism has further a tubular housing connected to an air supply source provided externally of the basic structure, a pressure reducing valve provided in the housing and a valve seal provided in the housing so that the pressure reducing valve can be pressed against and disengaged from this valve seal, wherein the valve is formed on the end of the sleeve which lies in the housing as the sleeve is inserted into and withdrawn from the housing and the opposite end of the sleeve is formed on its inner surface with threads.

The present invention includes such preferred embodiments as follows:

The sleeve and the housing are pressed against each other with an O-ring interposed between them.

The surface of the valve is permanently treated in order that the pressure reducing valve may be easily pressed against and disengaged from the valve seal.

PREFERRED EMBODIMENTS OF THE INVENTION

Details of a regulator for diving according to the present invention will be more fully understood from the description given hereunder in reference to the accompanying drawings.

Figure 1:
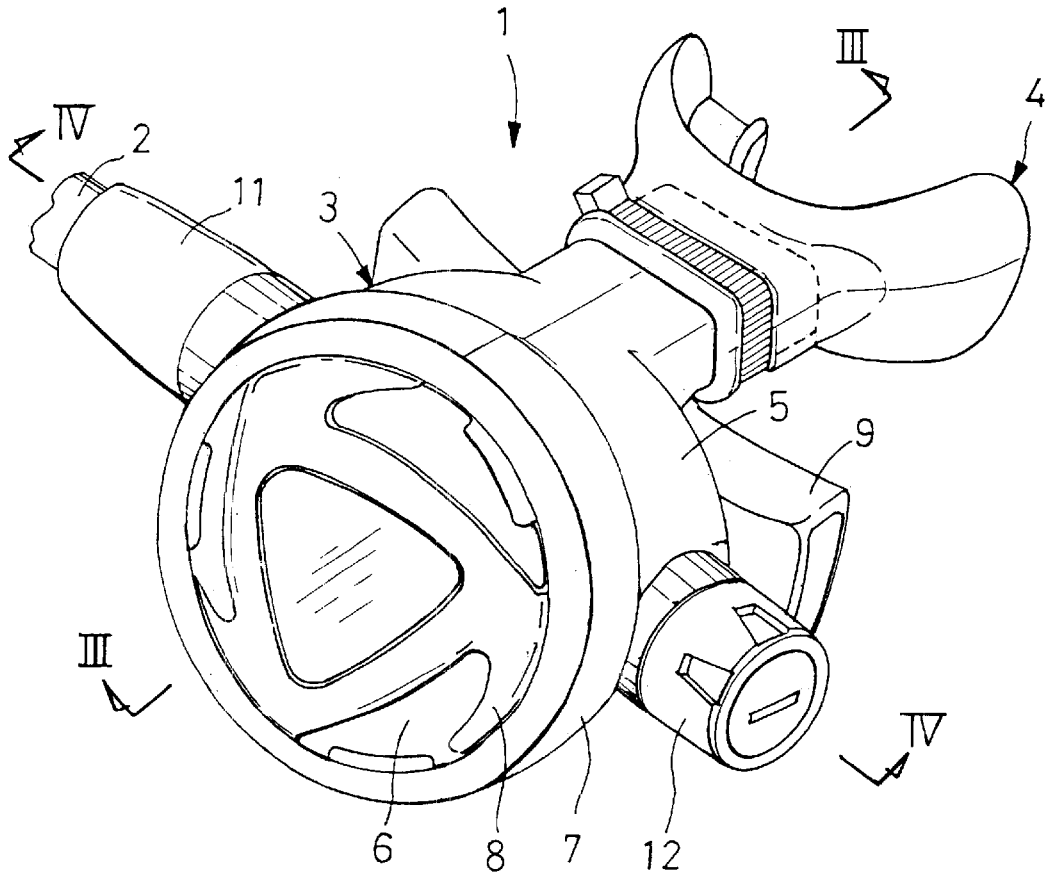
FIG. 1 is a perspective view of the regulator according to the invention.

A regulator 1 shown in FIG. 1 as a perspective view is adapted to be connected via a first stage (not shown) to a low pressure hose 2 extending from an air reservoir carried on a diver's back when the regulator 1 is used. The regulator 1 basically comprises a basic structure 3 and a mouthpiece 4 made of flexible elastic plastics. The basic structure 3 comprises a main body 5 made of rigid plastics, an elastic diaphragm cover 6 lying on the front side of the main body 5, first and second rigid retaining members 7, 8 for the cover 6, and an exhaust duct 9 lying on the rear side of the main body 5 extending right- and leftward as viewed in FIG. 1. An end of the low pressure hose 2 connected to the main body 5 is covered with a sleeve 11 on its left side as viewed in FIG. 1 and a pressure control knob 12 is positioned on its right side as viewed in FIG. 1.

Figure 2:
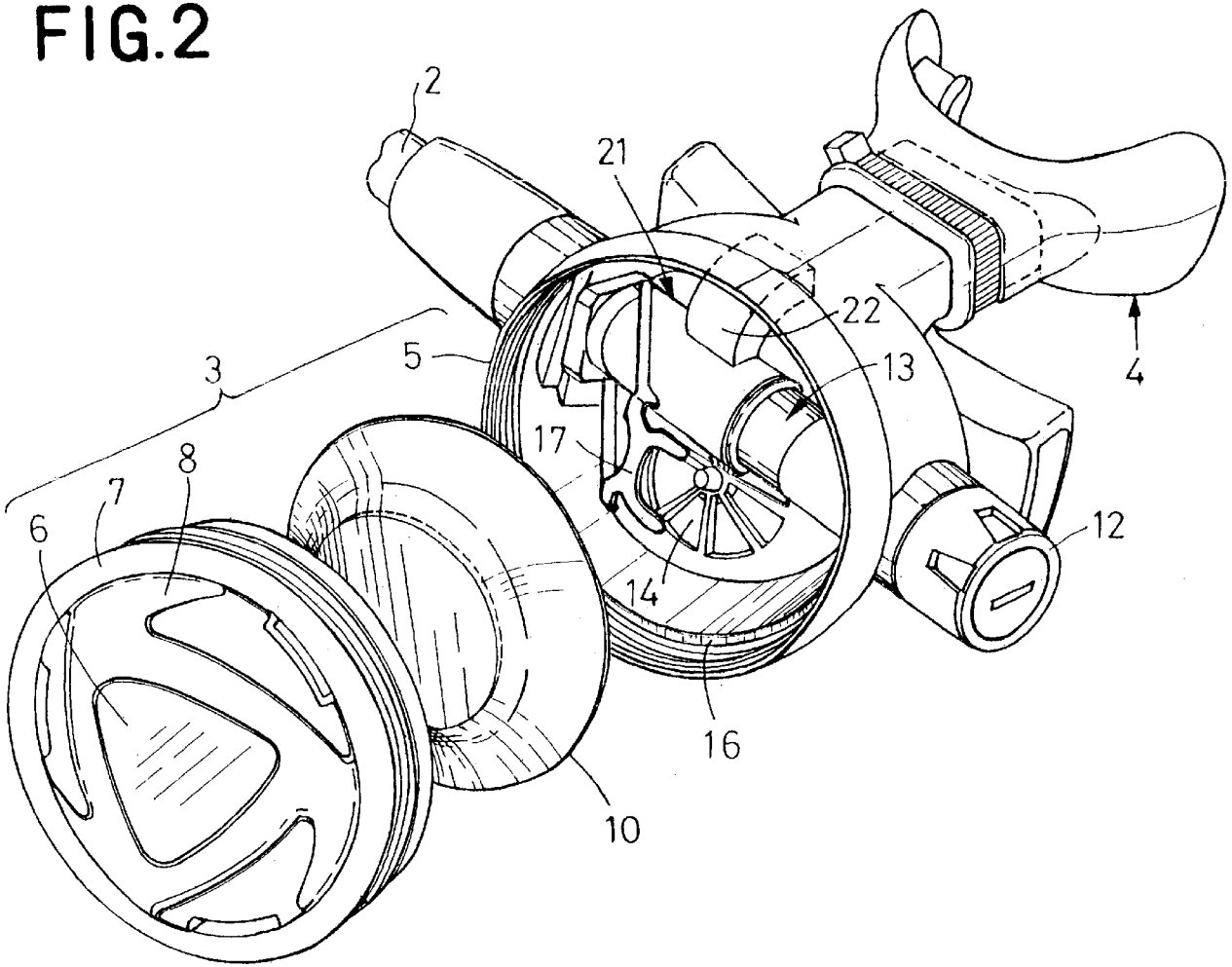
FIG. 2 is an exploded perspective view of the regulator.

FIG. 2 is an exploded perspective view fragmentarily showing the regulator 1. When the first retaining member 7 fixed by screw to the front side of the main body 5 may be unscrewed from the main body 5, the second retaining member 8 and the diaphragm cover 6 together with the first retaining member 7 are disengaged from the main body 5. Inside the main body 5 are provided with a diaphragm 10 and a tubular housing 13 containing therein a pressure control mechanism and on its rear side with a check valve 14 made of flexible elastic plastics (See FIG. 4 also). The diaphragm 10 made of a material usually used for this purpose is pressed air-tightly against a seal surface 16 formed on the periphery of the inner surface of the main body 5 by the first retaining member 7 screwed on the main body 5. The housing 13 is transversely extending through the main body 5 in such a manner as air-tightness is maintained between the housing 13 and the main body 5. A lever 17 extends from the housing 13 toward the diaphragm 10 and an extension 22 extends from a deflector 21 toward the mouthpiece 4.

Figure 3:
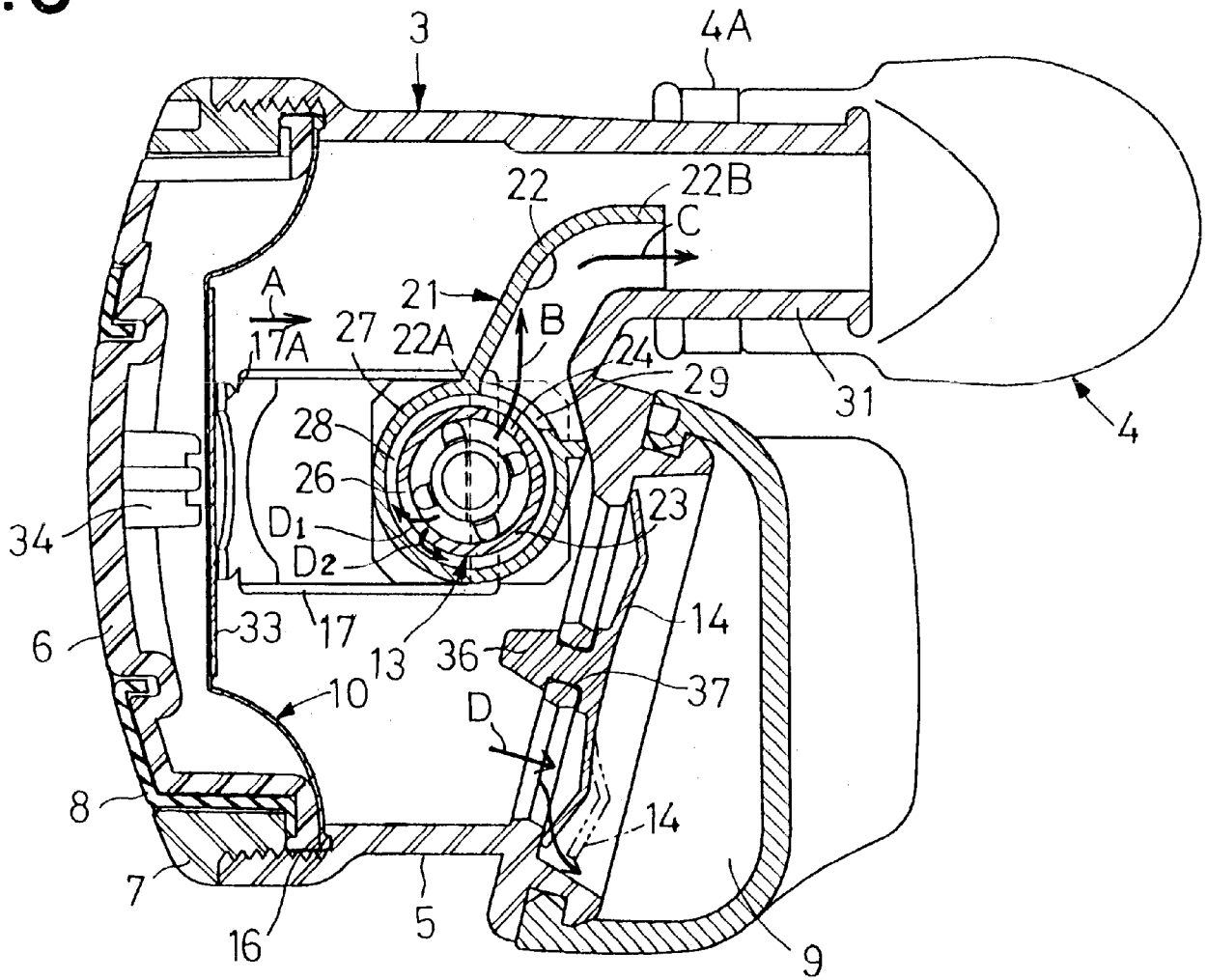
FIG. 3 is a sectional view taken along a line III—III in FIG. 1.

FIG. 3 is a sectional view taken along a line III—III in FIG. 1. On the peripheral wall 23 of the tubular housing 13 are provided with a first air outlet port 24 and a second air outlet port 26 (See FIG. 7 also). A tubular portion 27 of the deflector 21 is positioned slightly apart outwardly from the peripheral wall 23 forming a space 28 between these peripheral wall 23 and tubular portion 27. On the tubular portion 27 is provided with an air inlet port 29 in substantially the same alignment with the first air outlet port 24. The extension 22 has its proximal end 22A at the edge of the air inlet port 29 and extends outwardly in a radial direction of the housing 13. A distal end 22B of the extension 22 extending from its proximal end 22A lies in the vicinity of a joint section 31 of the basic structure 3. The mouthpiece 4 is secured around the joint section 31 by a band 4A.

The lever 17 extending from the housing 13 has its distal end 17A positioned adjacent to the inner surface of the diaphragm 10 or pressed against the diaphragm 10 with a reinforcing plate 33 therebetween. In the vicinity of the outer surface of the diaphragm 10, there is a projection 34 extending from the inner surface of the diaphragm cover 6.

The check valve 14 lying on the rear side of the main body 5 is disc-shaped and mounted on the main body 5 by forcibly fitting a projection 36 formed in the central port of the check valve 14 into a through-hole 37 of the basic structure 3. The duct 9 lies behind the check valve 14.

When a diver tries to inhale the air with the mouthpiece 4 held in his or her mouth, an air pressure inside the basic structure 3 lying on the right side of the diaphragm as viewed in FIG. 3 is reduced and the diaphragm 10 is moved to a direction indicated by an arrow A pushing the lever 17. The lever 17 pushed in this manner functions to open an air inlet valve (air supply valve) 72 (See FIG. 4) and the air flows from the low pressure hose 2 into the housing 13. A portion of the air flowing into the housing 13 flows out through the first outlet port 24 lying in front of the air supply valve 7 as viewed in the air flowing path in the housing 13, then flows through the air inlet port 29 to a direction indicated by an arrow B and its flow is obstructed by the extension 22 of the deflector 21 as it flows from below as viewed in FIG. 3. In consequence, this partial amount of the air flows to the mouthpiece 4 through a path indicated by an arrow C with its velocity reduced. Another portion of the air flowing into the housing 13 flows out through the second outlet port 24 of the housing 13 and, after interfered with the inner surface of the tubular portion 27 of the deflector 21, flows in directions indicated by arrows $D_1$ and $D_2$ at a reduced velocity in the space 28, then flows out through the inlet port 29, interfering with the extension 22 and then flows into the mouthpiece 4. When a diver exhales the air toward the basic structure 3, the diaphragm 10 and the lever 17 return to the respective positions as shown in FIG. 3 and simultaneously the air supply valve 72 in the housing 13 is closed to stop further air supply. The air exhaled opens the check valve 14 as indicated by imaginary lines in FIG. 3 and is exhausted via the duct 9. The extension 22 and the tubular portion 27 of the deflector 21 are spaced outwardly in a radial direction from the first outlet port 24 and the second outlet port 26, i.e., lie immediately above these outlet ports 24, 26, respectively, so as to cover them. The extension 22 covers the inlet port 29 also from immediately above.

Figure 4:
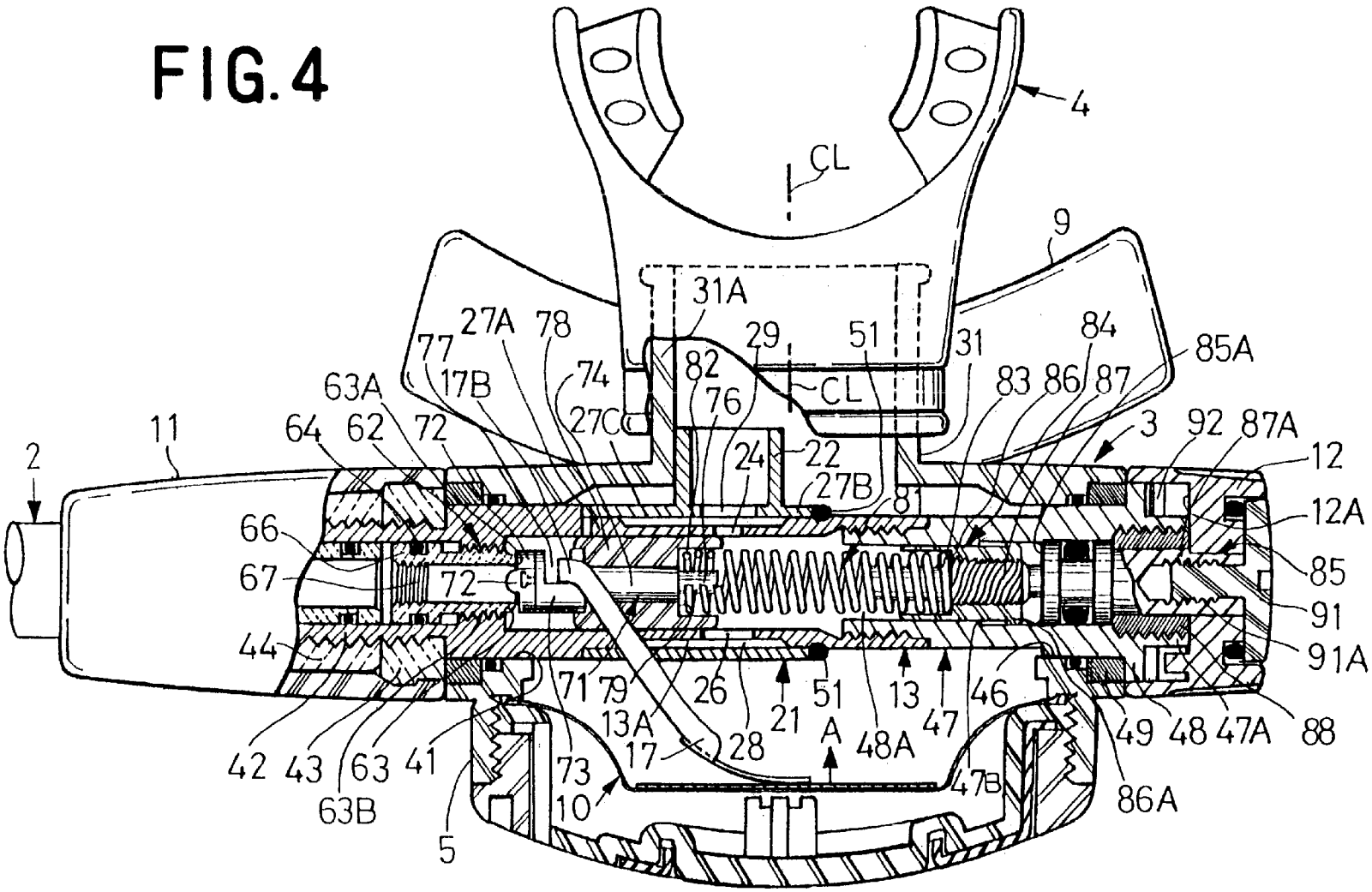
FIG. 4 is a sectional view taken along a line IV—IV in FIG. 1.

FIG. 4 is a sectional view taken along a line IV—IV in FIG. 1. The housing 13 housed in the main body 5 extends outwardly through a first through-hole 41 of the main body 5 opening on the left side as viewed in FIG. 4 and a nut 43 is screwed on this extension 42. The low pressure hose 2 is secured around a distal end of this extension 42 by a nut 44. As seen on the right side of FIG. 4, a tubular joint member 47 extending outwardly through a second through-hole 46 of the main body 5 is screwed on the right end of the housing 13. The joint member 47 is formed on its right end with a flange 48 pressed against the main body 5 from the right side with an annular spacer 49 therebetween. On the other hand, the nut 43 screwed around the extension 42 of the housing 13 is pressed against the outer side of the main body 5 from the left side. In this manner, the housing 13 is fixed to the main body 5.

The tubular portion 27 of the deflector 21 fit around the housing 13 in this manner has its longitudinally opposite ends 27A, 27B kept in close contact with the outer surface of the housing 13 and its intermediate portion 27C spaced from a diameter-reduced portion 13A of the housing 13 with the space 28 between the intermediate portion 27C and the outer surface of the housing 13. This diameter-reduced portion 13A is formed with the first and second outlet ports 24, 26 allowing fluid-flow between the inner side of the housing 13 and the space 28. The inlet port 29 of the deflector 21 lies above the first outlet port 24 as viewed in FIG. 4. The second outlet port 26 is so formed to have an opening area equal to or larger than that of the first outlet port 24 (See FIG. 7). The position of the extension 22 of the deflector 21 is offset from a center line CL bisecting a width of the joint section 31 of the basic structure 3 toward the right side as viewed in FIG. 4 and the extension 22 is pressed against an inner peripheral wall 31A of the joint section 31 from inside. The housing 13 is provided with an O-ring 51 placed against the end 27B of the deflector 21 from the right side to prevent the deflector 21 from moving rightward as viewed in FIG. 4.

As will be seen on the left side of FIG. 4, an air guide tube 62 is screwed around the periphery of the inner wall of the housing 13. This air guide tube 62 has a front end 63 offset toward the middle region of the main body 5 so as to form an orifice and a rear end 66 offset toward the outer end region of the main body 5 and kept in close contact with the inner surface of the housing 13 with an O-ring 64 therebetween. The front end 63 of the tube 62 is provided on its front face with a fluorine-treated seal surface 63A and on its outer surface with a thread 63B by which the front end 63 is secured to the inner surface of the housing 13. A rear end 66 of the tube 62 is formed on its inner surface with a screw thread 67. The air supply valve 72 for pressure reduction made of silicone rubber attached to a rear end 73 of a cylindrical stem member 71 is pressed against the seal surface 63A of the tube 62 from the right side as viewed in FIG. 4.

The stem member 71 has, in addition to the valve 72 and the rear end 73, an intermediate portion 74 extending on the right side of the rear end 73 and a front end 76 extending on the right side of the intermediate portion 74 so that the stem member 71 may have its outer diameter gradually reduced from the rear end 73 toward the front end 76. The rear end 73 is formed with a recess 77 adapted to receive an inner end 17B (See FIG. 6) of the lever 17. A guide member 78 is mounted around the intermediate portion 74 in such a manner as the guide member 78 can not rotate in a circumferential direction of this intermediate portion 74.

The guide member 78 is in contact with the inner surface of the housing 13 in such a manner as the guide member 78 can slide in the circumferential direction as well as in the axial direction of the housing 13. The front end 76 of the stem member 71 extends from the front end 79 of the guide member 78 (See FIG. 9).

A rear end 82 of a coil spring 81 is pressed against the front end 79 of the guide member 78. A front end 83 of the coil spring 81 is pressed against a rear end 86 of a slider 84 housed in the joint member 47.

The slider 84 is fit in an axial bore 48A of the joint member 47 in such a manner as the slider 84 is movable in the axial direction (left- and right directions as viewed in FIG. 4) but immovable in the circumferential direction of the joint member 47. In the axial bore 48A, there is provided a pressure control screw member 85 which is immovable in the axial direction but movable in the circumferential direction of the member 47 and the slider 84 is securely screwed around a multiple thread screw 87 formed on the rear end of the pressure control screw member 85.

The pressure control screw member 85 is protected by a nut 88 screwed into the front end 47A of the joint member 47 against falling off from the joint member 47. The knob 12 is mounted on a front end 87A of the screw member 85 by means of a set screw 91 so as to lie on the exterior of the main body 5. The set screw 91 has its threaded shank 91A screwed into the front end 87A of the screw member 85. A circular leaf spring 92 is interposed between the flange 48 of the joint member 47 and the knob 12. The leaf spring 92 is fixed to the inner surface 12A of the knob 12 and adapted to rotate together with the knob 12 (See FIG. 10).

Though not explained in details, an appropriate O-ring is interposed between each pair of mutually contacting members in order to keep the interior of the basic structure 3 in a substantially air-tight condition.

With the regulator 1 constructed as has been described above, the valve 72 is biased by the coil spring 81 to be pressed against the seal surface 63A of the tube 62 and thereby to prevent the air from flowing from the low pressure hose 2 into the housing 13. Inhalation of the air retained in the basic structure 3 by a diver deforms the diaphragm 10 which resultantly moves the lever 17 so that the inner end (proximal edge) 17B of the lever 17 may shift the stem member 71 rightward as viewed in FIG. 4 against the spring 81. Thereby the valve 72 in separated from the seal surface 63A allowing the air to flow from the low pressure hose 2 into the housing 13.

Figure 5:
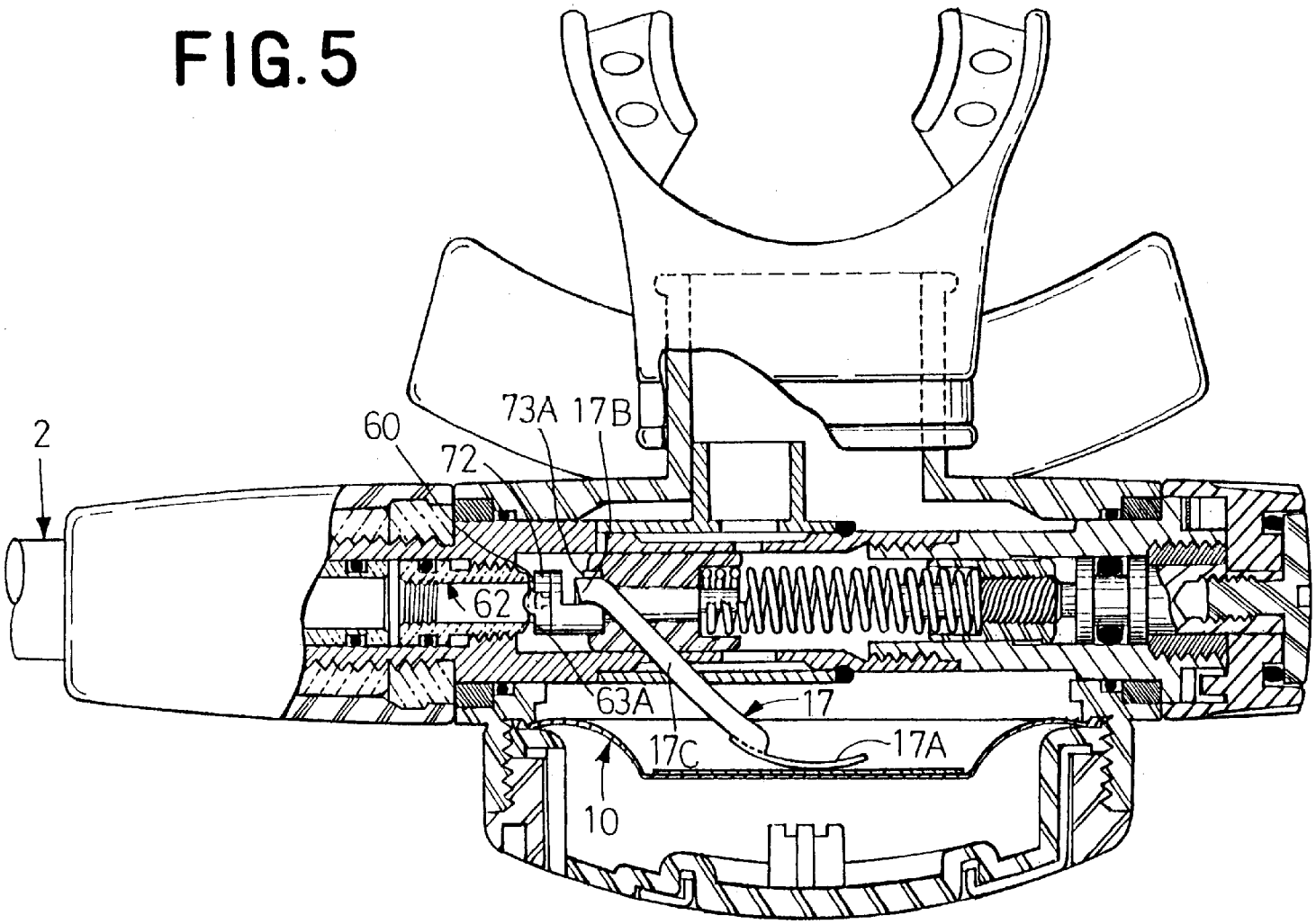
FIG. 5 is a view similar to FIG. 4 showing the regulator during air supplying.

FIG. 5 is a view similar to FIG. 4, showing a state in which the valve 72 is opened allowing the air to flow from the low pressure hose 2 into the housing 13. AS shown, the diaphragm 10 is deformed to push the outer end (distal edge) 17A of the lever 17 and the resultant movement of the lever 17 makes the valve 72 to be drawn away from the seal surface 63A. A gap 60 is formed between the valve 72 and the seal surface 63A and the air flows through the gap 60 into the housing 13.

Referring to FIGS. 4 and 5, a force exerted on the seal surface 63A by the valve 72 is controlled by varying a degree of compression of the spring 81 by rotating the knob 12. More specifically, this operation of adjustment is carried out as follows. First, the multiple thread screw 87 is rotated by rotating the knob 12 so that the slider 84 may linearly slide left- or rightward as viewed in FIGS. 4 and 5 to compress further or decompress the spring 81. More tightly the spring 81 is compressed, more forcibly the spring 81 causes the guide member 78 to press the valve 72 against the seal surface 63A. To separate the valve 72 in such a state from the seal surface 63A, a force sufficient to overcome the compressive force must be exerted upon the lever 17. The slider 84 slides rightward as viewed in FIGS. 4 and 5 until the flange 86A formed on its front end comes in contact with the end surface 85A of the screw member 85 and slides leftward as viewed in FIGS. 4 and 5 until the flange 86A comes in contact with a shoulder 47B of the joint member 47. A lead of the multiple thread screw 87 is preferably set so that the slider 84 slides over a full stroke defined between the end surface 85A and the shoulder 47B as the knob 12 makes a full rotation. With this, the diver can easily understand an approximate level at which the air pressure is adjusted on the basis of an angular position of the knob 12.

The air introduced into the housing 13 flows in directions indicated by arrows B, C, $D_1$, $D_2$ in FIG. 3 to the diver's mouth. In the course of the air flowing toward the diver's mouth, the air flow is obstructed by the deflector 21 whereupon the air has its flow velocity decreased and its flow width spread, facilitating the diver to inhale the air. Such pattern of air flow is also effective in avoiding a phenomenon of free flow of the air often occurring inside the basic structure 3 accompanied by the air flow from the housing 13, thereby preventing a degree of vacuum in the basic structure 3 from rising to an unacceptably high level. To make such effect more reliable, it is preferable to make an opening area of the second outlet port 26 of the housing 13 larger than that of the first outlet port 24. Such arrangement of the deflector 21 as laterally offset from the middle of the mouthpiece advantageously eliminates such apprehension as the supplied air might stimulate the diver's mouth from the front and, in addition, the deflector 21 might obstruct the diver's exhalation. The deflector 21 is directly mounted on the housing 13 so as to cover the first and second outlet ports 24, 26 from immediately above. Such arrangement effectively reduces the velocity of air flow.

As the tube 62 has its seal surf ace 63A treated with Teflon, the valve 72 may be smoothly separated from this seal surface 63A and it is reliably avoided that the valve 72 might be substantially fixed in close contact with the seal surface 63A and could not be easily separated from the seal surface 63A even after the regulator 1 has not been used for a long period of time. The tube 62 is formed on the inner surface of its rear end 66 with the thread 67. For maintenance and/or checking of the regulator 1, the tube 62 may be unscrewed from the housing 13 and then an appropriate bolt may be engaged with the thread 67 of the tube 62 to pull the bolt together with the tube 62 out from the rear end (the left side as viewed in FIGS. 4 and 5). In this way, the tube 62 can be quickly withdrawn from the housing 13 without any anxiety that the tube 62 might be damaged during this operation. Alternatively, the thread 67 may be previously configured so that the threaded shank 91A of the set screw 91 can be utilized as the bolt to eliminate the demand for the separately prepared bolt used for maintenance and/or check of the regulator 1.

Figure 6:
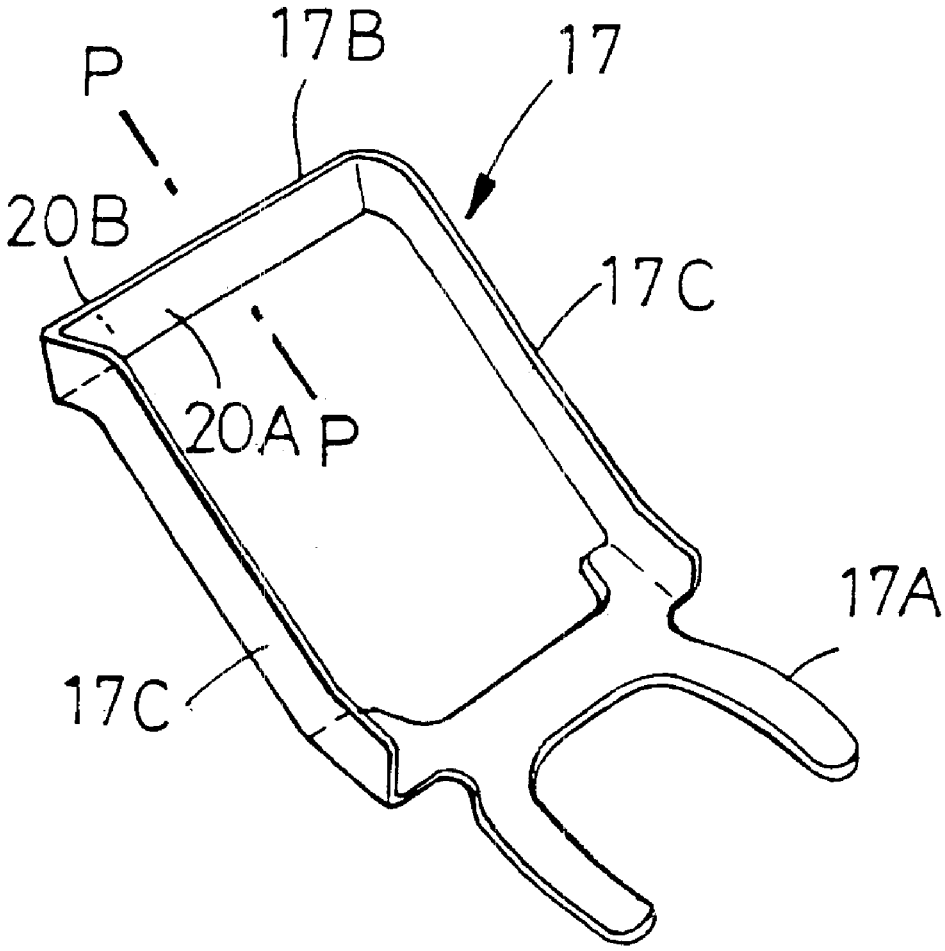
FIG. 6 is a perspective view of a lever.
Figure 7:
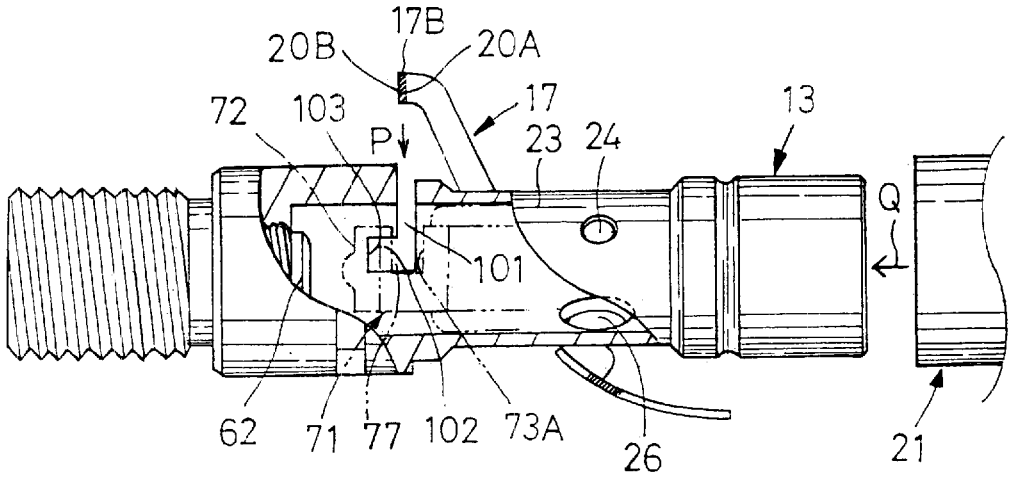
FIG. 7 is a side view showing the housing as partially cutaway.
Figure 8:
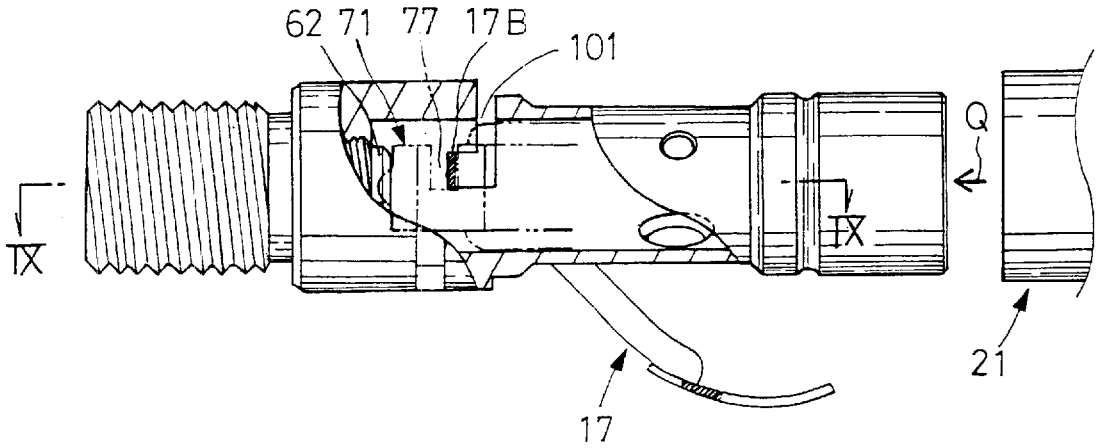
FIG. 8 is a view similar to FIG. 7 showing the housing with the lever mounted thereon.
Figure 9:
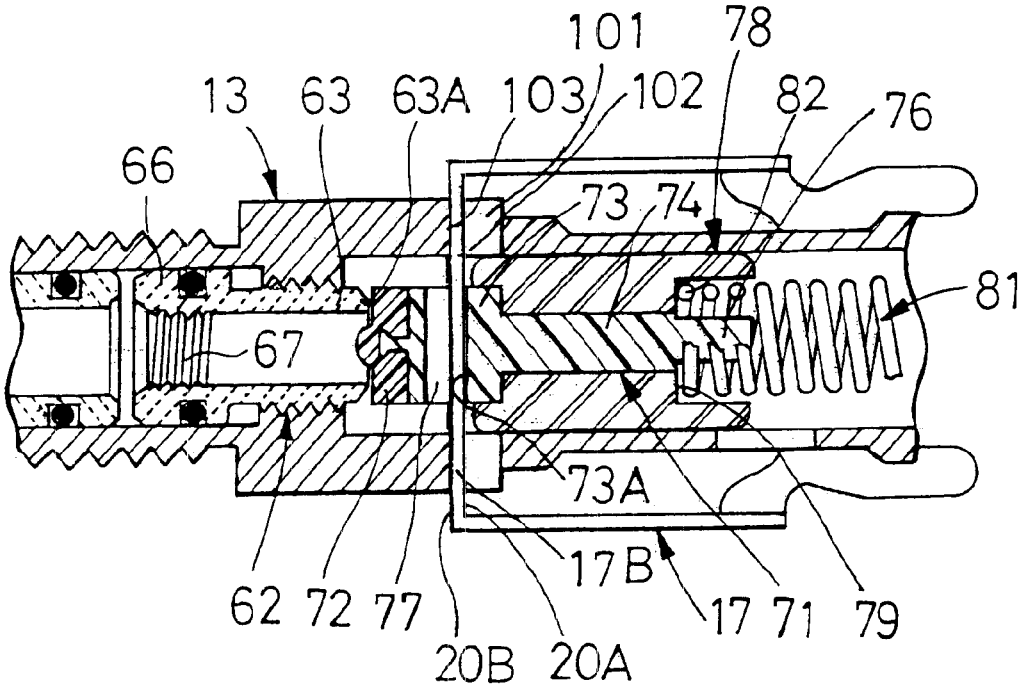
FIG. 9 a sectional view taken along a line IX—IX in FIG. 8.

FIG. 6 is a perspective view of the lever 17, FIG. 7 is an exploded side view showing the housing 13 as the region in which the lever 17 is mounted on the housing 13 has been cutaway, FIG. 8 is an exploded side view showing the housing 13 with the lever 17 mounted thereon as partially cutaway and FIG. 9 is a sectional view taken along a line IX—IX in FIG. 8. It should be understood that the housing 13 shown in FIGS. 7, 8 and 9 has the tube 62 and the stem member 71 (indicated by imaginary lines) mounted thereon but the other members such as the deflector 21 dismantled therefrom. Referring to these figures, the lever 17 is a metallic member having a substantially rectangular frame-like structure comprising the outer end 17A placed against the diaphragm 12, the inner end 17B partially received in the housing 13 and a pair of lateral sides 17C extending in parallel to each other between the outer and inner ends 17A, 17B. The inner end 17B is oriented perpendicular to an axis of the housing 13 extending horizontally as viewed in FIG. 7 and has a front surface 20A and a rear surface 20B. The inner end 17B presents a rectangular shape which is relatively long in vertical direction (See FIG. 8).

Now a procedure for mounting the lever 17 on the housing 13 will be described. The housing 13 is formed on its surface with a first cutout 101 diametrically extending in vertical direction as viewed in FIG. 7 and diametrically extending across the housing 13 as viewed in FIG. 9 and a second cutout 102 extending leftward (as viewed in FIG. 7) from the lower end of the first cutout 101 in the axial direction of the housing 13. The left end of the second cutout 102 defines a vertical end surface 103. The rear end 73 (See FIG. 4) of the stem member 71 has already been inserted into the housing 13 from the right side (See FIG. 4) as indicated by imaginary lines and the recess 77 of the rear end 73 lies at substantially the same vertical position as the first cutout 101. The housing 13 is inserted into the frame structure forming the lever 17, then the inner end 17B is inserted into the first cutout 101 in a direction indicated by an arrow P and the stem member 71 is received in the recess 77. Thereafter the inner end 17B is moved together with the stem member 71 leftward as shown in FIGS. 8 and 9 until the rear surface 20B of the inner end 17B is pressed against the end surface 103 of the second cutout 102 and the recess 77 of the stem member 71 has its wall surface 73A pressed against the front surface 20A of the inner end 17B. Then the deflector 21 is mounted on the housing 13 in a direction indicated by an arrow Q in FIG. 7. With the lever 17 mounted on the housing 13 in this manner, the wall surface 73A of the stem member 71 is pressed against the front surface 20A of the inner end 17B and the rear surface 20B of the inner end 17B is pressed against the end surface 103 of the housing 13 under the biasing force of the spring 81. In this manner, the lever 17 is held in its state as shown in FIG. 4. The inner end 17B of the lever 17 tilts (See FIG. 5) from its substantially vertical position as the lever 17 is pushed by the diaphragm 10 as seen in FIG. 5. As a result, the stem member 71 is moved forward (rightward as viewed in FIG. 8) against the force of the spring 81 to generate the gap 60. The stem member 71 restores its state shown in FIG. 5 as the diaphragm 10 restores its initial position.

According to the present invention, as the lever 17 in a form of a frame-like structure as shown in FIG. 6 is not easily deformed and its shape is stabilized, its handling is very easy. It is also possible to divide the inner end 17B of the lever 17 along a center line P—P and to dimension the lateral sides 17C to be relatively short as is the case with some of the conventional regulators. Obviously, such configuration has a problem that, as the respective lateral sides 17C are independently movable, the lever 17 is likely to be deformed. However, the housing 13 according to the present invention can overcome this problem. Specifically, the lever 17 can be easily mounted on the housing 13 merely by inserting the inner end 17B of the lever 17 into the first and second cutouts 101, 102 of the housing 13 no matter form of configuration the lever 17 may take. It is not required for a diver to deform the lever 17 in order to mount the lever 17 on the housing 13 and therefore even the deformable lever as has often been used in a regulator of prior art can effectively function in the regulator according to the present invention.

Figure 10:
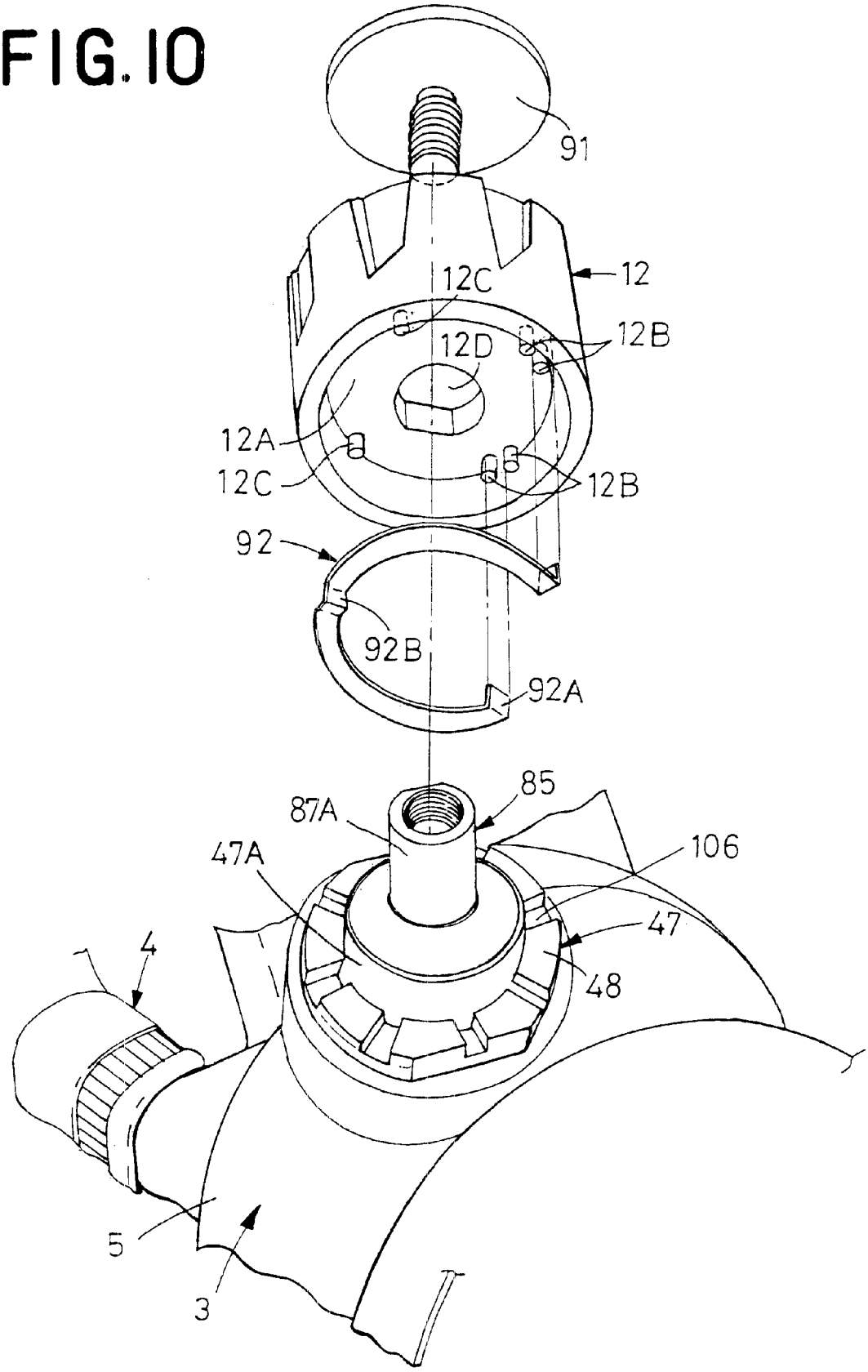
FIG. 10 is an exploded perspective view showing fragmentarily the basic structure of the regulator.

FIG. 10 is an exploded perspective view showing fragmentarily the joint member 47 and the knob 12. On the surface of the flange 48 of the joint member 47 facing the knob 12, a plurality of grooves 106 extending in a radial direction of the flange 48 are formed and arranged at regular intervals in a circumferential direction. On the inner surface 12A of the knob 12 are provided with a plurality of projections 12B and a curcular or horseshoe-shaped leaf spring 92 is attached to the inner surface 12A by inserting bent portions 92A of the leaf spring 92 into a gap defined between each pair of the adjacent projections 12B. On the inner surface 12A are additionally provided with projections 12C adapted to support the leaf spring 92 with an appropriate flexibility. The leaf spring 92 is provided with a projection 92B which is convex toward the flange 48. The front end 87A of the screw member 85 is inserted into a through-hole 12D of the knob 12 to make the leaf spring 92 attached to the knob 12 contact with the flange 48 and the set screw 91 is screwed into the front end 87A of the screw member 85 from outside of the knob 12. The joint member 47 inclusive of the flange 48 is fixed to the main body 5 and the screw member 85 integrated with the knob 12 rotates relatively to the joint member 47. When the knob 12 is rotated, the projection 92B of the leaf spring 92 is alternately engaged and disengaged with the grooves 106, providing the knob 12 a ratchet function.

The deflector 21 of the regulator 1 according to the present invention is mounted on the outer side of the housing 13 so as to cover the first and second outlet ports 24, 26 for air supply from immediately above. So far as such feature is concerned, the present invention can be implemented with the housing 13 having only the first outlet port 24 or only the second outlet port 26, i.e., without any restriction on the number of the air inlet ports. For the housing 13 having only the second outlet port 26, it is also possible to use the deflector 21 comprising the tubular portion 27 only without the extension 22.

The regulator according to the present invention is primarily characterized in that the tube has the thread formed on the inner surface of its end opposite to the end formed with the valve seal. This unique arrangement allows the tube to be withdrawn from the housing by thread-engaging an appropriate bolt around the tube. In this way, the tube can be easily withdrawn from the housing without damaging the tube.

What is claimed is:

1. A regulator for diving comprising a basic structure adapted to be kept in substantially air-tight condition so long as a diver is actually using it, a pressure-controllable air supply mechanism provided in said basic structure to supply the diver with air, a mouthpiece connected to said basic structure and a check valve provided in said basic structure so as to be switched between opened and closed positions, said regulator further comprising:

said air supply mechanism having a tubular housing to be connected to an air supply source provided externally of said basic structure, a pressure reducing valve provided in said tubular housing and a valve seal against which said pressure reducing valve is releasably pressed wherein said valve seal is formed on a front end of an air guide tube which is withdrawably inserted into said tubular housing and said air guide tube is formed with threads on an inner surface of a rear end thereof, the rear end opposite to the front end of the air tube guide.

2. The regulator according to claim 1, wherein said air tube guide and the tubular housing are pressed against each other with an O-ring interposed between them.

3. The regulator according to claim 1, wherein said valve seal has permanent surface treatment in order that said pressure reducing valve may be easily releasably pressed against said valve seal.

* * * * *

UNITED STATES PATENT AND TRADEMARK OFFICE

CERTIFICATE OF CORRECTION

PATENT NO. : 6,681,766 B1
DATED : January 27, 2004
INVENTOR(S) : Mitsushiro Matsuoka It is certified that error appears in the above-identified patent and that said Letters Patent is hereby corrected as shown below:

Column 8,
Line 59, "of the air tub" should read -- of the air tube --.

Signed and Sealed this

Seventeenth Day of August, 2004

JON W. DUDAS
*Acting Director of the United States Patent and Trademark Office*